United States Patent [19]

Leclere

[11] 4,026,543

[45] May 31, 1977

[54] DOCUMENT ARTICLE HANDLING CONTROL

[75] Inventor: Ralph Joseph Leclere, Boulder County, Colo.

[73] Assignee: International Business Machines Corporation, Armonk, N.Y.

[22] Filed: Nov. 28, 1975

[21] Appl. No.: 636,252

[52] U.S. Cl. ..... 271/259; 271/64; 271/173

[51] Int. Cl.² ..... B65H 29/60; B65H 7/02

[58] Field of Search ..... 271/64, 173, 258, 259; 270/58

[56] References Cited

UNITED STATES PATENTS

| | | | |
|---|---|---|---|
| 3,204,950 | 9/1965 | Hanchett, Jr. | 271/259 |
| 3,343,672 | 9/1967 | DeVries et al. | 271/64 X |
| 3,432,035 | 3/1969 | Adams | 209/74 |
| 3,588,472 | 6/1971 | Glaster et al. | 235/92 |
| 3,626,956 | 12/1971 | Sauder | 271/259 X |
| 3,709,485 | 1/1973 | Acquaviva | 270/58 X |
| 3,778,629 | 12/1973 | Terryn | 271/259 X |
| 3,813,157 | 5/1974 | Fantozzi | 355/14 |
| 3,817,175 | 6/1974 | Heiber et al. | 271/64 X |
| 3,833,896 | 9/1974 | Suzuki | 271/258 X |
| 3,848,995 | 11/1974 | Gauronski | 270/58 X |
| 3,878,540 | 4/1975 | Kawai | 271/259 X |
| 3,930,581 | 1/1976 | Gray | 271/173 X |
| 3,948,510 | 4/1976 | Iwamoto et al. | 271/258 |

*Primary Examiner*—Robert W. Saifer
*Attorney, Agent, or Firm*—Herbert F. Somermeyer

[57] ABSTRACT

A document reproduction machine, such as a convenience copier, has an operator selected noncollated tray output and a collated output. An intermediate copy count, a transient copy count, and a document tracking indicator cooperate with decision logic to provide an automatic control for some copy overflows and error recovery control. For jam recovery, the transient count alters the intermediate count such that copies lost in a paper path are accounted for. Diverse modes of operation alter the timing of the jam detection circuits so as that one copy sensor is operative in any mode for precise jam detection. The modes also alter operation of the jam detection circuits so that one jam circuit operates in all modes. Collator to copy machine interlocks ensure no copy production occurs until the collator jam has been cleared. Upon a jam in the copy machine, local timing signals replace normal timing signals from the copy machine so that the collator can finish collating good copies and yet immediately stop the copy machine. Nonoverlapping of copy runs facilitate jam recovery.

70 Claims, 8 Drawing Figures

MISFEED RECOVERY TIMING DIAGRAM

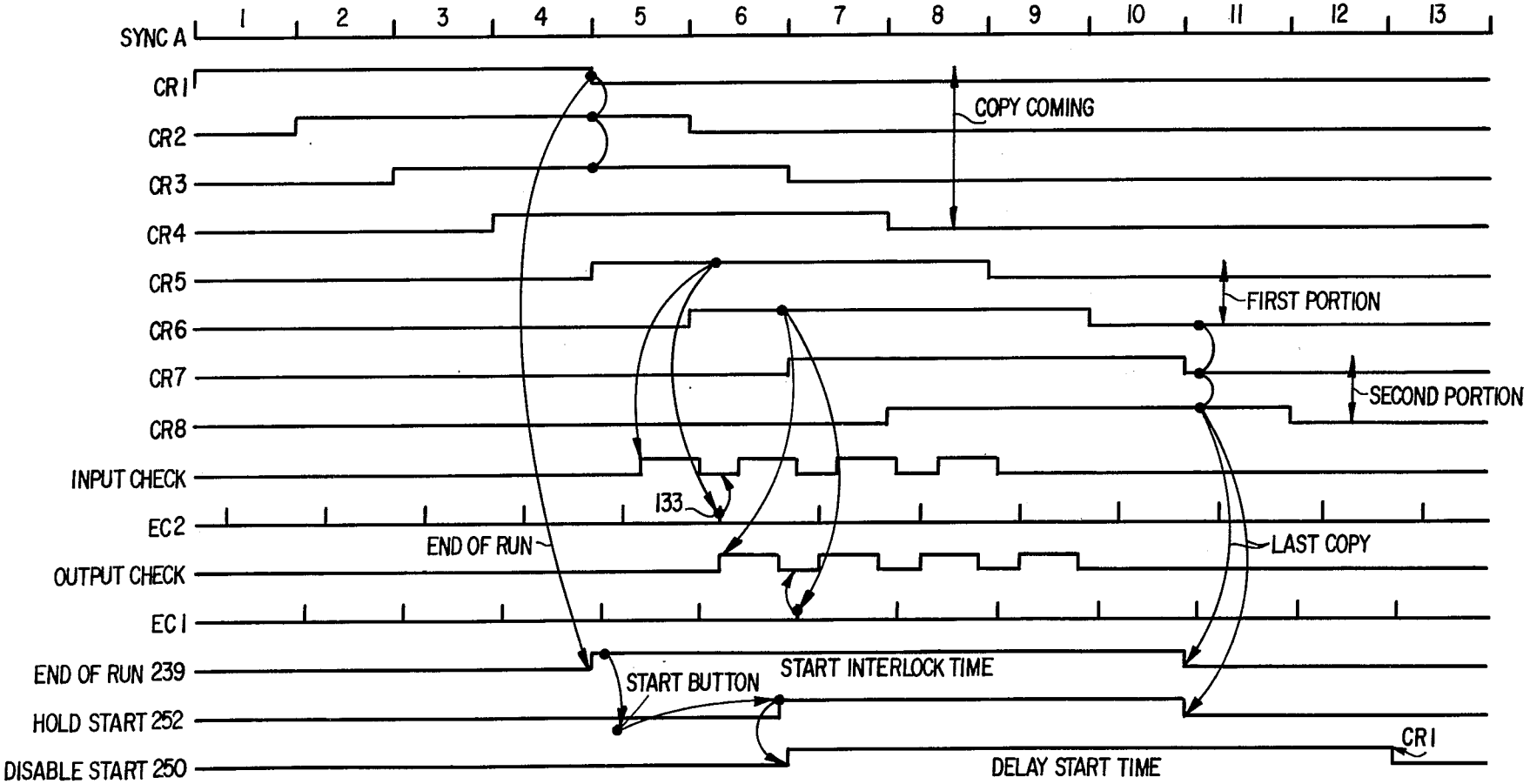
FIG. 5 DOCUMENT TRACKING TIMING DIAGRAM

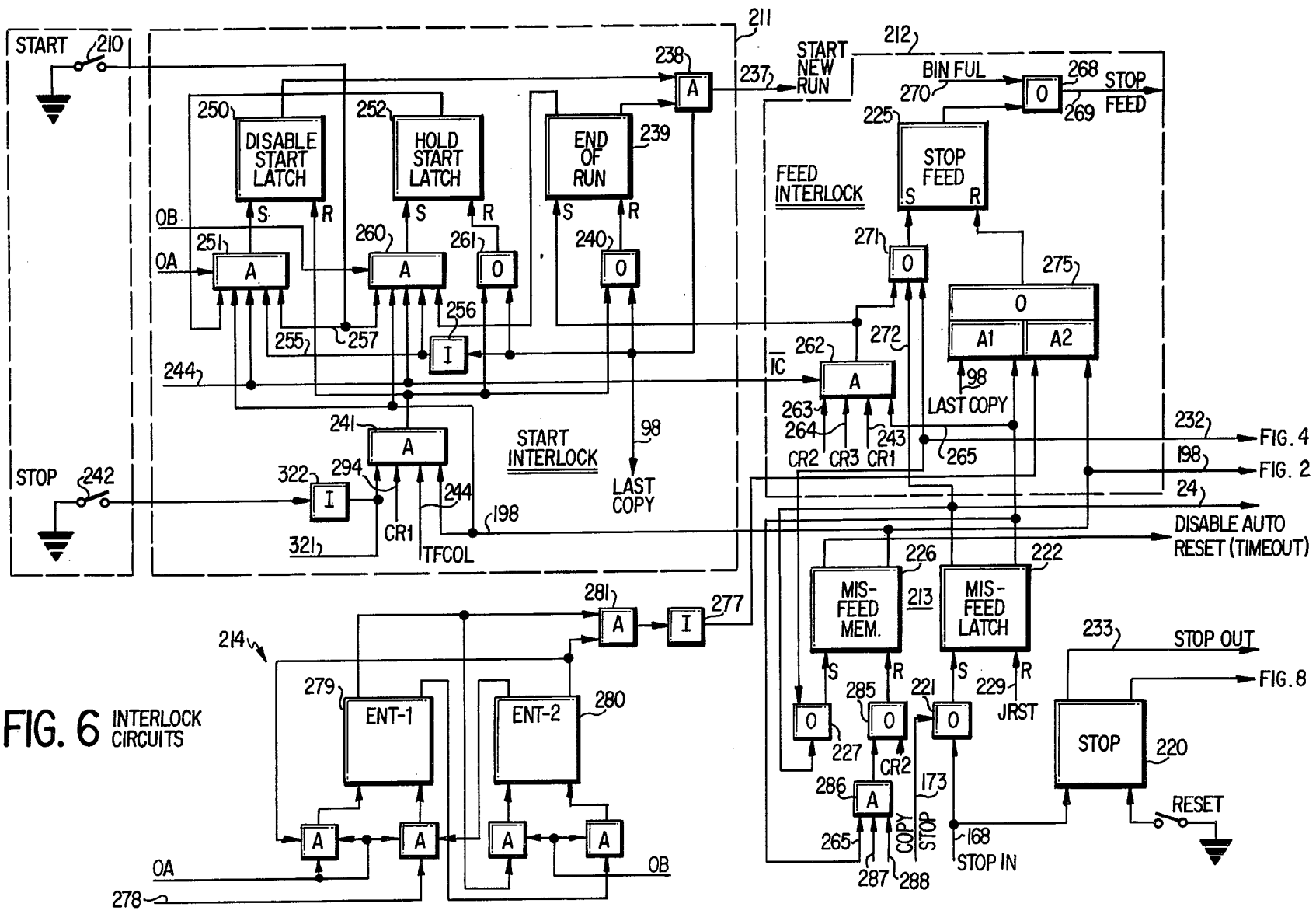
FIG. 6 INTERLOCK CIRCUITS

DOCUMENT ARTICLE HANDLING CONTROL

BACKGROUND OF THE INVENTION

This invention relates to article handling methods and apparatus including automatic control means for preventing overfeeding articles (copies) and misfeed recovery with respect to a plurality of output portions.

In document reproduction machines having a high-speed copy reproduction portion and a document output portion, the reproduction portion usually can reproduce more documents than can be stored in either a noncollate output tray or a collate output portion. Many of these machines are sufficiently fast in document reproduction that operator control is ineffective to prevent a paper jam; i.e., the document reproduction portion may supply more documents than can be handled by either the collator or the tray. Since a jam can occur any place along a paper path, the machine should compensate for same by always producing a requested number of copies.

SUMMARY OF THE INVENTION

It is an object of the invention to provide document-/article handling machine controls having multimode operations automatically switchable to accommodate a maximum number of documents being reproduced, as well as a misfeed recovery irrespective of operator selections.

In one aspect of the invention, a control for an article transfer apparatus has a plurality of article sensing means disposed along a path of travel. A plurality of output portions is provided. A first or intermediate up/down counter counts articles to a given one of said output portions. A second or transient up/down counter indicates the number of articles being transferred through the apparatus, and error recovery means respond to an error indicia from one of the sensing means to alter the count of the first up/down counter in accordance with the contents of the second up/down counter. Further, the first up/down counter is used in article overflow direction means wherein an output portion is filled to capacity by articles. Automatic control means respond to the full signal to transfer articles to another output portion.

In another aspect of the invention, article tracking means, preferably a shift register, signifies that articles are to be received, the articles are being transferred through a first portion, and that articles are leaving through a second or third portion. The sensing means cooperate with the tracking means to indicate errors anywhere along the article transfer path. One portion of the tracking means is operative with a plurality of said output portions for indicating article misfeed.

In yet another aspect of the invention, the article transfer means comprises a collator receiving copies from a document reproduction machine. The aforementioned controls cooperate with the document reproduction machine controls for interlocking operation such that each plural copy run is separate and distinct, while single copy runs can be overlapped. Both the start button and document feed interlocks are provided. Additional controls are provided for clearing the collator upon a misfeed in the document reproduction machine.

The foregoing and other objects, features, and advantages of the invention will become apparent from the following more particular description of a preferred embodiment of the invention, as illustrated in the accompanying drawing.

THE DRAWING

FIG. 5 is a timing diagram illustrating a portion of the operations of the misfeed detector shown in FIG. 4.

FIG. 6 is a simplified diagrammatic showing of interlocking circuits coordinating operation of a collator and a document reproduction machine.

DETAILED DESCRIPTION OF THE INVENTION

Figure 1:
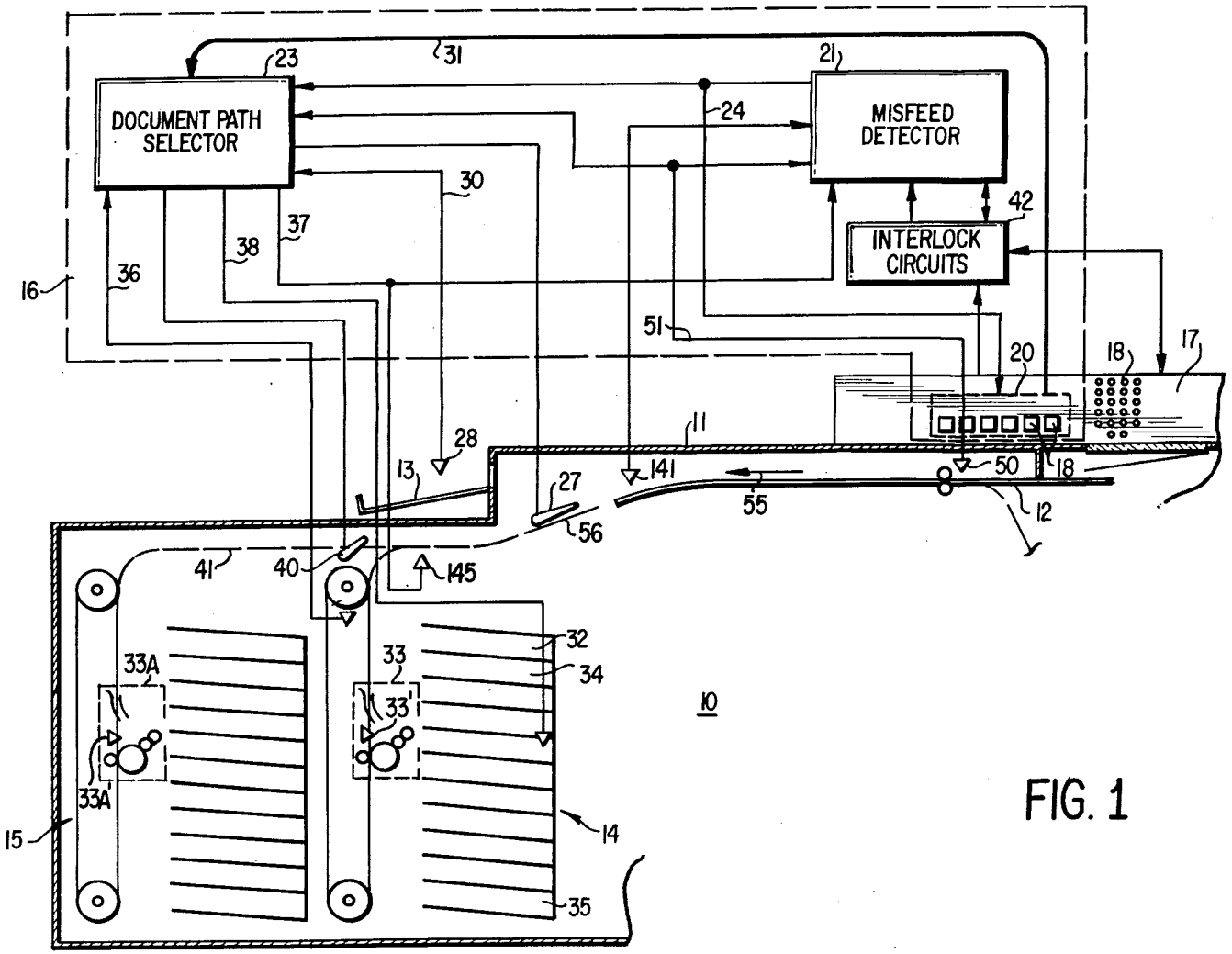
FIG. 1 is a combined simplified, diagrammatic, elevational and signal schematic diagram of a document reproduction machine, a collator, and interconnecting article transfer apparatus.

Referring now more particularly to the drawings, like numerals indicate like parts and structural features in the diagrams. A document reproduction machine includes an electrostatic-type document reproduction portion 10, such as shown in U.S. Pat. No. 3,834,807. Document reproduction portion 10 supplies reproduced documents to a document transportion portion 11 which transports received documents from a transfer point 12 (the exit portion of reproduction portion 10) to noncollate output tray 13, first collator 14, or second collator 15. If the document reproduction portion 10 is operable in a duplex mode, i.e., can copy on both sides of the paper, a duplexing station (not shown) is included in the document reproduction portion. An automatic control means 16 controls the operation of the document reproduction portion 10, document transport portion 11, and collators 14 and 15. Conveniently located on document reproduction portion 10 is an operator control panel 17 having a plurality of function selection switches 18 which, inter alia, select collate or noncollate modes, paper size, number of copies, and the like. Electronic copier control circuits, which may include a programmable microprocessor, are installed adjacent operator control panel 17 as indicated by dashed line box 20. This portion of the control is peculiar to the operation of document reproduction portion 10 and is not further described for that reason; the cited reference indicates the type of control functions that are necessary to be performed in connection with constructing and using an electrostatic document reproduction portion 10.

Also included in the automatic control means 16 is misfeed detector 21 responsive to a plurality of sensors hereinafter explained in more detail. A misfeed signal results from a document jam in the document transport portion 11 or in the operation of collators 14 and 15. Document reproduction portion 10 has its own misfeed detector (not shown). Upon detection of improper document transport, misfeed detector 21 supplies a misfeed signal over line 24 to copier control 20 for turning the machine off and to document path selector 23 for limiting or stopping document transporting in collators 14 and 15.

When the operator selects a noncollate mode via control panel 17, automatic control means 16 actuates document deflecting gate 27 to a downward position (an upward position is illustrated) whereby documents received via portion 11 are inserted into noncollate output tray 13. A tray-full sensing switch 28 senses when tray 13 has reached its document capacity. Switch 28 then closes to supply a tray-full signal over line 30 to document path selector 23. Selector 23 responds to the tray-full signal and to a noncollate mode indication from panel 17 received over cable 31 to activate first collator 14 and then move gate 27 to the illustrated upward position directing subsequently received documents to collator 14. Collator 14 responds by first filling its uppwardmost collate document-receiving bin 32, and then stepping the sorting carriage 33 downwardly to the second bin 34, and so forth, through bin 35, until the first collator 14 is filled. Assuming that each collator 14 bin each can receive 75 copies, 1,500 copies can be inserted in the collator 14 in a noncollate mode.

When collator 14 has moved its sorting carriage 33 to the bottommost position and the bottommost bin 35 has been filled, the full condition of collator 14 is supplied to document path selector 23 over lines 36, 37, and 38, as will be hereinafter more fully described. At this time, document path selector 23 adjusts document deflection gate 40 from the illustrated upward position wherein documents are deflected to collator 14 to a downward position wherein documents received from gate 27 are deflected upwardly to document path 41 from entry and collation into second collator 15.

Operation of the two collators is identical. When the second collator 15 has filled all of its document-receiving bins and its sorting carriage 33A has reached its lowermost position, a full signal is supplied by document path selector 23 to the operator panel 17 and the document reproduction machine is turned off.

Additionally, it is desired to allow overlapped single copy runs, while keeping multiple copy runs mutually exclusive. That is, when document reproduction machine 10 is producing multiple copies of the same original, the complete reproduction and collation of those copies is completed prior to the initiation of reproduction from another original. To achieve these results, interlock circuits 42 intercommunicate with document reproduction machine 10, control panel 20, and misfeed detector 21 to coordinate operation of the machine portions. Document reproduction machine portion 10 is not started before a misfeed condition has been cleared in collators 14 and 15 or transport path 11.

NONCOLLATE MODE

Figure 2:
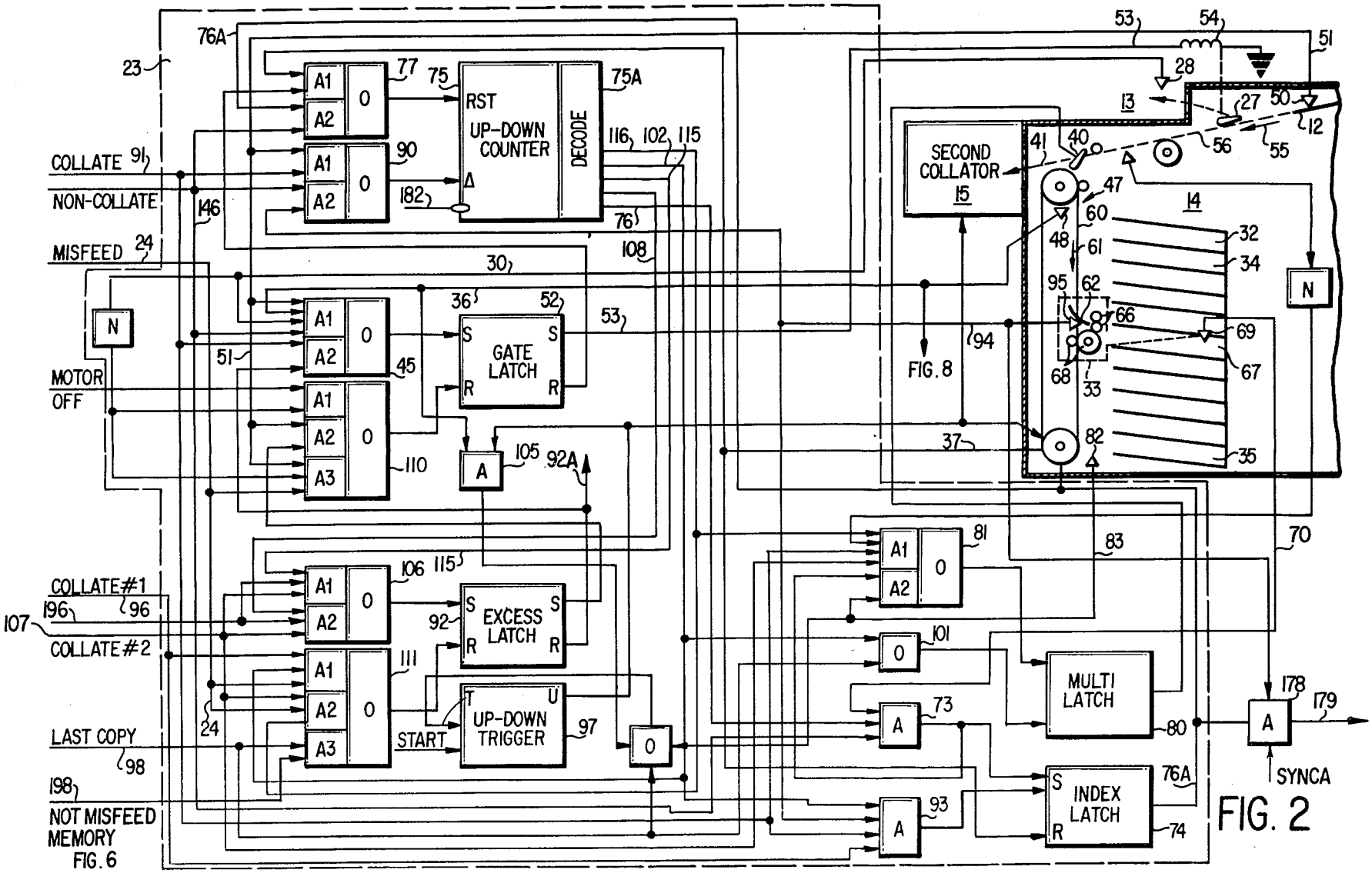
FIG. 2 is also a combined diagrammatic and schematic diagram showing portions of the FIG. 1 illustrated machine, in particular, a document path selector portion of the automatic control means.

The description of FIG. 2 starts assuming that document reproducing portion 10 has been placed in the noncollate mode via operation panel 17. Reproduced documents exit portion 10 via transfer point 12 and are transported through document transport portion 11 and deflected by gate 27 into noncollate document receiving tray 13. Switch 28 continuously senses whether or not tray 13 is full. When full, switch 28 supplies a tray-full signal over line 30 to the Al (AND) input portion of AO circuit 45 (AO means AND-OR) of document path selector 23. The other enabling inputs to the Al portion include the "not collate" signal received over line 146 of cable 31 from control circuits 20 of document reproduction portion 10 and the line 36 signal from swtich 48. The latter signal indicates sorting carriage 33 is in the home or upwardmost position as at 47. When all three signals are active, gate 27 can be activated in a synchronous relation to a document entering transport 11 at transfer point 12. In this regard, input sensing switch 50 supplies a document received signal over line 51 to complete the enablement of the Al input portion of AO 45. AO 45 then sets gate latch 52 to the active condition for supplying an enabling signal over line 53 to gate actuating solenoid 54 to move gate 27 to the FIG. 1 illustrated upward position. Then, documents traveling in portion 11, as indicated by arrow 55, instead of being deflected upwardly into noncollate document-receiving tray 13, continue on the document travel path indicated by dash line 56 toward collators 14 and 15. Travel path 56 is constructed using known techniques and is not further described for that reason. The documents traveling along path 56 finally reach document deflection gate 40 to be deflected downwardly into collator 14. Documents from path 56 deflected by gate 40 are carried by endless vacuumized belt 60 downwardly, as indicated by arrow 61. Irrespective of the vertical location of sorter carriage 33, indexing vane 62 on carriage 33 intercepts the document being transported by vacuum belt 60, deflecting it to move between a pair of driven rollers 66, thence into a selected one of the document-receiving bins, such as bin 67. The intermediate rollers 68 driven by belt 60 rotate driven rollers 66 as long as belt 60 is rotated. Sorting carriage 33 moves vertically under control of downward path selector 23 when in the noncollate mode; in the collate mode, the sorting carriage is stepped differently.

As above-mentioned, initially carriage 33 is in the home position 47 closing switch 48 such that the documents passing by gate 40 are deflected into uppermost document-receiving bins 32. In the noncollate mode, in one embodiment, documents are supplied to bin 32 without indexing carriage 33 until bin-full sensing switch 69 indicates that the appropriate number of documents have been inserted into bin 32. In a later-described embodiment, a counter 75 indicates when a bin is full. At this point, switch 69 supplies a signal over line 70 partially enabling AND circuit 73. When AND circuit 73 also is receiving the noncollate signal from line 146, it responds to the up/down counter 75 having an intermediate article count to supply a line 76 signal for indexing sorting carriage 33 to the next collator bin. In one constructed embodiment, up/down counter 75 actuates AND circuit 73 when the counter 75 indicates that one more than the number of documents to be received by bin 32 (or any other bin) has passed transfer point 12. This indication resulted from switch 50 incrementing up/down counter 75 each time a document enters transport portion 11. When count decode 75A of counter 75 has detected that the number of documents in the output portion is one greater than the capacity of the document-receiving bins 32, 34, etc., it supplies an enabling signal over line 76. Then, AND 73 sets index latch 74 to the active condition actuating motor (not shown) operatively connected to sorter carriage 33, moving it downwardly one bin position in preparation for transporting the next group of received documents to bin 34, etc. Simultaneously, index latch 74 supplies its signal over line 76A through AO 77, via A2 input portion to reset up/down counter 75 to the reference state. This action prepares counter 75 for counting the number of documents to be entered into bin 34. The line 146 noncollate signal partially enables the A2 input portion.

When sorting carriage 33 has indexed down one position, it supplies a signal over line 37 resetting index latch 74. Bin 34 can now be filled with noncollated documents such that when it is filled, index latch 74 is again set and the cycle repeated for each of the bins in collator 14.

When collator 14 is filled, gate 40 moves to a down position deflecting documents from collator 14 into collator 15 which operates as above described for collator 14. Gate 40 moves under the control of multilatch 80, which is set to the active condition via the A2 input portion of AO 81. A bottom sensor 82 of collator 14 supplies an active signal over line 83 which is combined by A2 input portion of AO 81 with the output signal of AND 73. This signifies that bin 35 is full and that carriage 33 is at the bottom of collator 14. Hence, collator 15 should now be used. It should be noted that, depending upon the length of belt 60, the bin-full sensor 69 relationship to bin 35 can be altered by the construction of bin 35 such that the number of documents currently in collator 14 on belt 60 does not exceed the required capacity. In the alternative, bin 35 can be made larger to accommodate a greater number of documents to avoid a jam problem. Also, the count control scheme described above can be employed.

COLLATE MODE

Intermediate article counter 75 in the collate mode also counts documents emitted by copier 10 at transfer point 12. Sensing switch 50 supplies an indicating signal over line 51 to the Al input portion of AO circuit 90 which is partially enabled by a collate signal received from control 20. Gate 27 diverts the documents from noncollate tray 13 to travel along path 56. This is done initially via the A2 input portion of AO 45 setting gate latch 52. The AO 45 A2 input portion responds to the collate signal on line 91 and to the excess latch 92 being reset to supply the gate latch 52 setting signal. At each document from path 56 enters collator 14, it is transported as above described, down vacuum belt 60, to sorting carriage 33.

Each time a document is inserted into one of the collator bins, such as 32 and 34, carriage 33 is stepped downwardly one bin position. Index latch 74 supplies the carriage 33 stepping signal over line 76A. To generate the stepping signal in the collate mode, collate signal on line 91 partially enables AND circuit 93 to set index latch 74. Other inputs to AND circuit 93 are 1-to-20 count signal on line 102 from decoder 75A, a document exit indication from vane 62 received over line 94 from a sensor 95 in carrige 33, and a number 1 collator attachment indicating signal received over line 96. The latter signal results from a collator 14 being connected to portion 10. Upon completion of indexing one bin position, collator 14 supplies an index complete signal over line 37, resetting latch 74 in preparation for the next collating step.

Upon reaching the bottom of collator 14, the direction of travel of the carriage is reversed by up/down trigger 97. Trigger 97 is initially set to the down indicating position, i.e., carriage 33 is in its home position at the top of the collator. Upon reaching the bottom of collator 14, carriage 33 collates upwardly. To reverse the collating direction of travel, either the last-copy signal received over line 98 from portion 10 or the signal on line 83 from sensor 82 triggers up/down trigger 97 to the opposite state thereby reversing the direction of carriage 33 travel. The last-copy signal on line 98 can be generated in portion 10 in the known manner; i.e., the number-of-copies register (not shown) is compared with a copy-generated counter (not shown) to indicate that the last copy of a run has been sent. The signal is suitably delayed to allow for transportation of the last copy from transfer point 12 to vane switch 95 of carriage 33.

To reverse the direction of carriage 33 travel upon reaching home position at 48, AND circuit 105 responds to the home signal on line 36 and to the up/down trigger 97, indicating an up direction to supply a trigger signal, triggering up/down trigger 97 to the down-indicating signal state.

When the number of copies to be collated is greater than the number of document-receiving bins of collator 14, multilatch 80 is set to the active condition actuating gate 40 to the down position for deflecting documents from path 56 into collator 15 rather than into collator 14. Operation of collator 15 is identical to that described for collator 14 and includes circuits as above described; i.e., index latch 74 is repeated in collator 15. When the carriage in collator 15 corresponding to carriage 33 of collator 15 reaches the bottom, an up/down trigger, such as trigger 97 for collator 14, is triggered to the opposite state. A last-copy signal on line 98 is also supplied to second collator 15 for performing the same function.

Whenever a last-copy signal is received over line 98, multilatch 80 resets for returning gate 40 to the illustrated position. Multilatch 80 is also reset via OR circuit 101. Whenever the copy count indicated on line 102 by counter 75 is decoded as being in the range 1-to-20, this also resets multilatch 80. Additionally, a bottom sensor in collator 15 such as sensor 82 of collator 14 can be used to reset multilatch 80.

The above-described operation in the collate mode occurs when the number of copies to be collated does not exceed the total number of document-receiving bins in both collators 14 and 15 and the number of copies to be collated does not exceed the document-receiving capacity of the individual bins.

In the event that the collate request is for collating a number of pages greater than the number of document-receiving bins in both collators 14 and 15, the first number of copies equal to the number of document-receiving bins is placed in the two collators; and excess numbers of copies are placed in the noncollate tray 13 as noncollated copies. To this end, excess latch 92 and gate latch 52 cooperate to deflect document gate 27 to the down position for deflecting documents into tray 13. The A2 input portion of AO circuit 106 responds to the collate 2 signal on line 107 from control 20 indicating a second collator is attached and to the signal on line 108 indicating that the last document of the capacity of the two collators 14 and 15 has been received at transfer point 12, as indicated by counter 75 setting excess latch 92. Excess latch 92 being set partially enables the A2 input portion of AO 110 in preparation for resetting gate latch 52. The document received indicating signal on line 51 passes through the input portion of A0 110 resetting gate latch 52 which disables solenoid 54 allowing gate 77 to be spring-biased downwardly into a tray 13 document deflecting position. The documents residing in path 56 are still collated as above described and the subsequently received documents are transferred to tray 13. When portion 10 indicates a last copy, excess latch 92 resets, which enables the A2 input portion of AO 45 together with the collate signal on line 91, again setting latch 52 in preparation for receiving documents to be collated from portion 10.

When the number of copies to be made of each page being collated is greater than the capacity of the individual bins, the apparatus is stopped requiring operator intervention for removing the copies collated up to the capacity of the bins. Then the apparatus can be restarted to finish the collating operation. The above-described operation forms no part of the present invention and, hence, is not described or illustrated. However, when the number of pages to be collated exceeds the number of document-receiving bins in collators 14 and 15, the excess pages are inserted into noncollate tray 13. When the number of copies made of each page equals the capacity of the collator document-receiving bins, the apparatus is stopped, requiring all copies made up to that point to be removed by an operator.

In the event that only collator 14 is operatively connected to the document reproduction portion 10, the A1 input portion of AO 106 responds to the collate nunber 1 signal on line 96 and the collator bin capacity indicating signal on line 115 to set excess latch 92. Latch 92 being set, sets gate latch 52 which operates in the afore-described manner. Excess latch 92 can also be reset by A1 input portion of AO 111. Whenever decode 75A indicates an up/down count within the capacity of collator 14, an enabling signal supplied over line 102 is combined with the collate 1 signal on line 96 and a misfeed signal received over line 24 to reset excess latch 92. Additionally, the A2 input portion of AO 111 is responsive to the misfeed signal on line 24. Collate 2 signal on line 107, plus the indicating signal on line 116, indicates that the copy count is within the range of collator 15 to reset excess latch 92. This action enables recovery from a misfeed which is beyond the scope of the present description. However, in this regard, up/down counter 75 is decremented, as later described, whenever a misfeed signal on line 24 enables same to be counted down. Such down counting recovers the count in the apparatus up to the point of jam, such that the appropriate number of copies or documents are produced by the apparatus.

MISFEED DETECTOR 21

Figure 3:
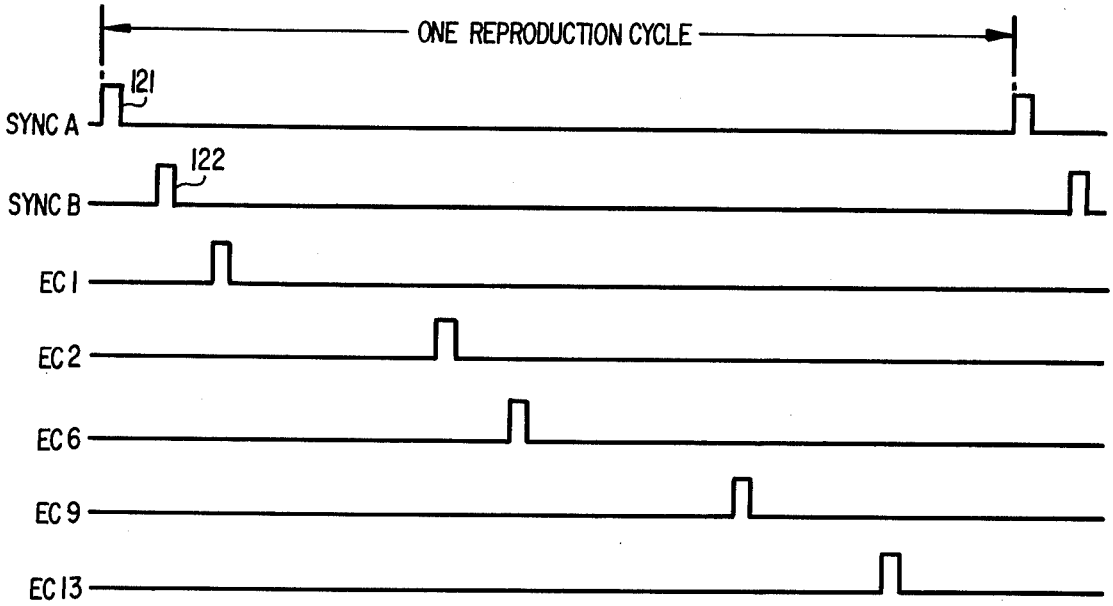
FIG. 3 is a timing diagram used to describe the FIG. 2 illustrated apparatus and, in particular, showing a reproduction cycle timing of the document reproduction machine.
Figure 4:
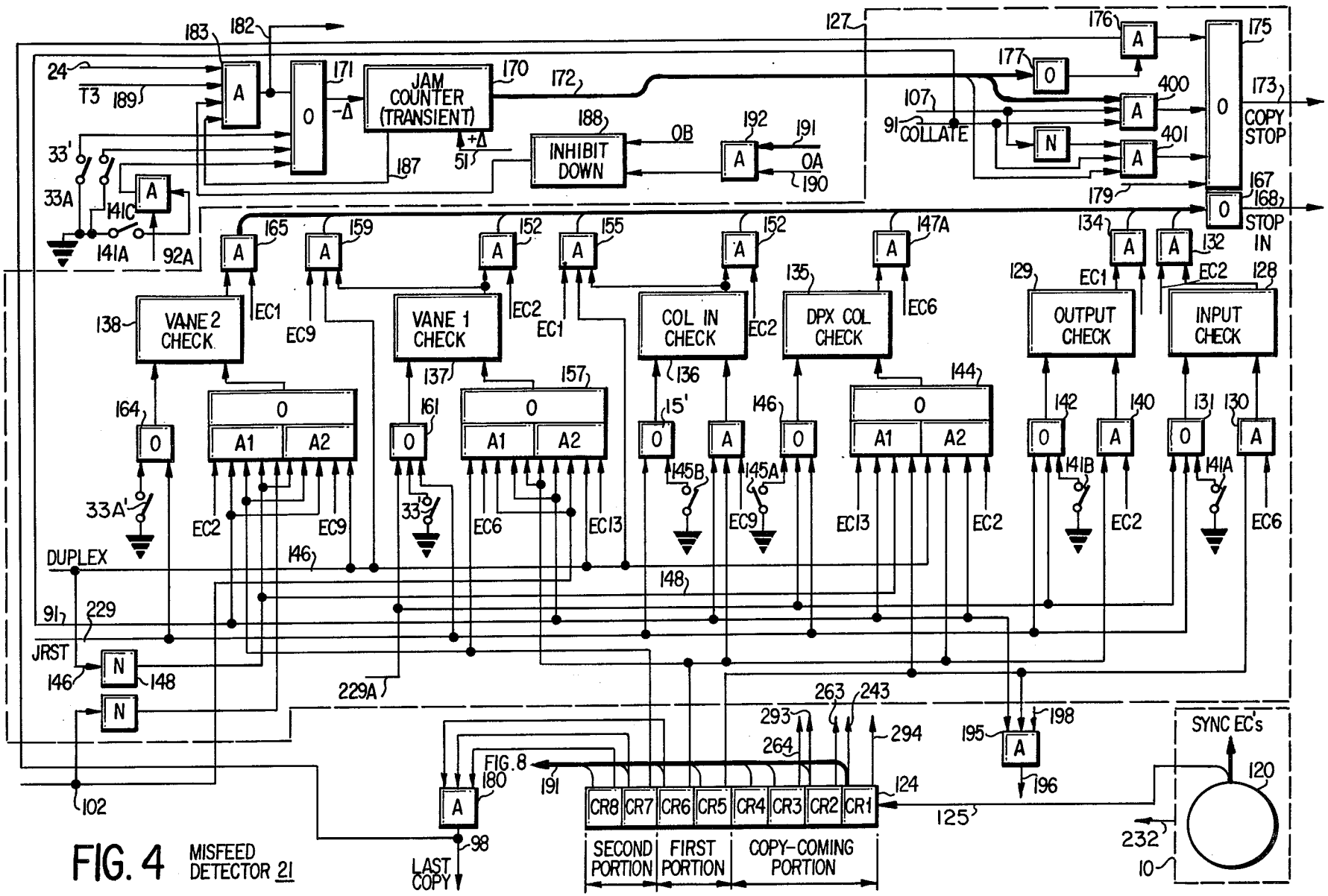
FIG. 4 is a schematic signal flow diagram of a misfeed detector circuit portion of automatic control means for the FIG. 1 illustrated apparatus.

Referring next to FIG. 4, document article tracking and fault detection and recovery are described. Document reproduction machine portion 10, shown as a dashed line box in FIG. 4, includes a so-called emitter wheel (tachometer) 120. This emitter wheel 120 is synchronized to the operation of document reproduction machine portion 10, preferably fixedly secured to a so-called photoconductor drum, such as shown in U.S. Pat. No. 3,834,807. Emitter wheel 120 identifies the reproduction cycles of machine 10 shown in FIG. 3. Each reproduction cycle begins by a so-called SYNCA pulse 121. A second reproduction cycle synchronizing pulse SYNCB 122 closely follows the SYNCA pulse. The SYNCB pulse may be derived from the SYNCA pulse using known time-delay techniques. Additionally, a plurality of emitter timing pulses (EC's) is emitted for operating document reproduction machine 10. Certain of these timing pulses are received by the automatic control means 16 of FIG. 1 for operating in complete synchronism with document reproduction machine 10. These pulses, labeled EC1, EC2, EC3, EC9, and EC13, are shown in timing relationship of FIG. 3. For purposes of clarity, in FIGS. 4 et seq, the timing pulses are labeled with no illustrated connections to emitter wheel 120. In FIG. 4, the term "SYNC EC's" signifies SYNCA through EC13.

A undirectional document tracking shift register 124 having stages CR1 through CR8 (CR means copy register) receives reproduction cycle indicating pulses from emitter wheel 120 over line 125, such as the SYNCA pulses. A pulse on line 125 signifies that a sheet of blank paper has been picked by document reproduction machine 10 for making a duplicate copy from an original. Stages CR1–CR4 of shift register 124 signify to automatic control means 16 that a copy is coming from document reproduction machine portion 10. Document reproduction machine portion 10 may have a duplicate register of stages CR–CR4 for detecting misfeeds. In register 124, a document at a particular position is indicated by a binary 1 being stored in the appropriate stage, a binary 0 indicating absence of a copy. Accordingly, when a binary 1 is shifted by a pulse on line 125 from CR4 to CR5, a duplicate copy is signified as being transferred from the document reproduction machine portion 10 through transfer point 12 signifying that switch 50 should soon sense the copy. As the copy is transferred past deflection gate 27 and over path 41, or to collator 14 or to copy receiving output tray 13, a binary 1 is shifted from CR5 through CR6, etc.

Stages CR5 and CR6 represent a first portion of the article transfer path consisting generally from sensing switch 50 to deflection gate 27. CR7 corresponds to control of collator 14, while CR8 corresponds to control of collator 15. In a noncollate mode, CR7 and CR8 are ignored. CR7 and CR8 constitute a second portion of shift register 124.

A goodly portion of misfeed detector 21 constitutes fault detector 127. Fault detector 127 jointly responds to the signal content of shift register 124 signifying copy transport status and the switches along the copy transport path signifying actual transport status to indicate faults or misfeeds and for stopping a portion or all of the machine assembly; i.e., a so-called "soft stop" may stop only document reproduction machine 10 allowing the automatic control circuits 16 to finish collating the copies resident in the copy path or everything may be turned off at once, as will become apparent.

A first portion of fault detector 127 includes checking latches 128 and 129 responsive to the first portion CR5 and CR6 of register 124. Latch 128 checks the arrival of a copy at switch 141, while latch 129 checks for transfer of a copy from switch 141 to deflector gate 27. Input check latch 128 is set by AND circuit 130 whenever CR5 contains a binary 1 and emitter time EC6 occurs. It is seen in FIG. 3 that EC6 occurs at about the center of each reproduction cycle. As seen in FIG. 5, a four-copy run is being transported through to a collator. CR5 is activated at the beginning of the fifth reproduction cycle, and input check latch 128 becomes active at the center of the fifth reproduction cycle. Check latch 128, under normal and satisfactory operating conditions, remains set until switch 141 senses the beginning of a document which closes contacts 141A. When contacts 141A close, a control pulse goes through OR circuit 131 resetting input check latch 128. In the subsequent reproduction cycle 6, timing pulse EC2 senses AND circuit 132 to determine whether or not input check latch 128 has been reset, as previously described. If it has been reset, EC2 is blocked and no fault is indicated. If input check latch 128 has not been reset, AND 132 passes EC2 to OR circuit 167 as a fault signal.

In FIG. 5, the EC2 timing pulse at 133 is shown checking input latch 128 at about one-third of the way through; reproduction cycle 6, the cycle following the cycle 5 in which check latch was set to the active condition. All of the check latches 129 and 135–138, inclusive, operate in a similar manner; i.e., copy register 124 cooperates with emitter wheel 120 timing pulses as indicated in FIG. 4 to set a given check latch. The set latch is reset by a signal developed by a sensor somewhere in the travel path for disabling a fault determining AND circuit, such as AND circuit 132. Additionally, after an error recovery, the check latches have to be reset, as will be more fully described later.

Output check latch 129 is set to a checking condition by AND circuit 140 responding to EC2 and the CR6 stage containing a binary 1. Latch 129 is reset by switch 141 contacts 141B supplying its active signal through OR circuit 142. Hence, switch 141 supplies a first signal through OR circuit 131 upon arrival of a copy and a second signal through OR circuit 142 when a copy leaves switch 141. Several circuit-switch arrangements may be employed to achieve the above-stated function. In this manner, switch 141 monitors the paper path in both an upstream and downstream manner. This technique enables one switch position to monitor a larger segment of the paper path. This also checks for a paper hang-up on switch 141.

Check latch 135 checks for a duplex or collator input transfer. An AO circuit 144 sets latch 135 either in a collate or duplex mode. The A1 input portion of A0 144 responds to the collate signal on line 91, timing pulse EC13, and not-duplex signal on line 148, plus the CR5 being set to the active condition in the first portion of shift register 124. The A2 input portion also sets latch 135; however, at timing pulse EC2, when the machine is in so-called duplex mode, as indicated by the signal on line 146; and CR6 is set to the active condition. The A2 input portion of A0 144 sets latch 135 at a time later than the A1 input portion. This is necessary because of additional time required in a duplexing operation. Exit switch 145 contacts 145A supply an active signal through OR circuit 146 resetting latch 135. AND circuit 147A at time EC6 tests for proper resetting of check latch 135.

Check latch 136 also responds to the first portion of shift register 124, stage CR6, to the collate mode and to EC9 for initiating a checking cycle. As a copy leaves switch 145, contacts 145B of switch 145 reset latch 136 via OR circuit 151. AND circuit 152 verifies that collator input latch 136 has been reset in each reproduction cycle by timing pulse EC2. Switch 145 monitors the paper path in its area as switch 141 monitors its area.

AND circuit 155 checks at time EC1 in the duplex mode for whether or not latch 136 has been reset. This corresponds to the A2 input portion of A0 144, whereas AND circuit 147A corresponds to the A1 input portion of A0 144, nonduplex mode.

The remaining two check latches 137 and 138 check collators 14 and 15 having sucessfully transferred a copy to be collated via one of the two sorting carriages 33 or 33A. The A1 input portion of A0 circuit 157 sets vane 1 check latch 137 to the active condition for a checking cycle at time EC6 during a collate mode, when CR6 is active, duplex is not active, and the overflow count is between 0 and 21 as indicated by an active signal on line 102. AND circuit 128 checks that latch 137 has been reset before time EC2 of the next reproduction cycle. In a similar manner, the A2 input portion of AO 157 sets latch 137 to initiate a turning cycle during the duplex mode, as indicated by the signal on line 146 at time EC13 when the signal on line 102 indicates the overflow counter is counting for the first collator 14 and collation is to occur. AND circuit 159 checks for resetting of latch 137 corresponding to the A2 input portion input during the duplex mode and at time EC9 of the following document reproduction cycle.

Normally, latch 137 is reset by switch 33' sensing a copy. OR circuit 161 transfers the active signal to reset latch 137.

Check latch 138 checks collator 15 as above described for latch 137. Copy sensing switch 33A' supplies a latch resetting signal through OR circuit 164 for resetting latch 138 to show a successful operation. And circuit 165 tests the condition of latch 138 at time EC1.

Any of the AND circuits 132, 134, 147A, 152, 165, 159, and 155, all of which check the above-described check latches, supply a fault signal necessary for stopping all operations. OR circuit 167 passes any of the signals from the above-mentioned AND circuits as a stop-in signal over line 168 to interlock circuits 42 which, in turn, transfer the stop signal to document reproduction machine portion 10 for stopping the machine. The automatic control 16 uses the stop-in signal, as will be later described.

Recovery from such a fault requires manual intervention, i.e., the misfed copies must be removed from the machine. However, the machine should automatically recover to the point of the misfeed. To enable such a recovery, jam counter 170 maintains a transient count of the number of documents beint transferred between transfer point 12 and the output portions 13, 14, and 15. Accordingly, sensing switch 50 (FIG. 1) also supplies its indicating signal over line 51 to increment the count in jam counter 170. Jam counter 170 counts up to the maximum number of documents residing between transfer point 12 and either carriage 33 or 33A. After a misfeed, recovery includes counting the count in jam counter 170 to zero under control of AO 171, as will be later described.

The signal content of jam counter 170 travels over cable 172 to fault detector 127 for detecting a misfeed in the downstream of the copy path, i.e., after the document has sucessfully passed deflecting gate 27. Such a misfeed causes a copy-stop signal (soft stop) to travel over line 173 to the interlock circuits, as will be described. Generation of the copy-stop signal is via OR circuit 175. One form is the misfeed in a carriage 33 or 33A. To this end, AND circuit 76 responds to the last-copy signal on line 98 and to any of the jam counter stages being active as indicated by OR circuit 177. That is, when the last copy is detected, the jam counter should have counted to zero. Another soft stop occurs when carriage 33 (FIG. 1) does not index. AND circuit 178 (FIG. 2) supplies a signal over line 179 to OR circuit 175 (FIG. 4) whenever index latch 74 remains set and the next copy enters carriage 33; a signal on line 94 enables AND circuit 178 to send an active signal over line 179 to generate a copy-stop signal. Also, AND circuits 400 and 401 respond to the indicated transport conditions during a collate mode (line 91) to generate a line 173 copy-stop signal.

The last-copy signal is detected by AND circuit 180 responding to CR6 and CR7 being reset and CR8 being set to the active condition. That is, the copy should have passed the positions of the travel path respectively indicatable by CR6 and CR7 and are now being exited by carriages 33 and 33A. In the alternative, of course, the copies can go to tray 13 and would have before CR8 is reset. For simplicity, the last-copy signal is generated from shift register 124 as above described. Down counting jam counter 170 is achieved by the vane switches 33′ and 33A′, respectively, on carriages 33 and 33A supplying their signals through OR circuit 171 to decrement jam counter 170. Additionally, in the noncollate mode and non-overflow mode, switch 141 senses entry of a copy into receiving tray 13. AND circuit 141C gates switch 141A signal as shown in FIG. 4 from the not excess latch signal on line 92A.

Jam counter 170 counts the number of copies lost during the misfeed. Accordingly, when jam counter 170 is down-counted, the decrementing signals from AND circuit 183 are also supplied over line 182 to decrement updown counter 75 as well as being supplied to document reproduction machine portion 10 for down counting its copy counter (not shown). To this end, AND circuit 183 is enabled by the misfeed signal received over line 24, an enabling signal from inhibit down latch 188, an not-zero signal on line 187 from jam counter 170. Completion of the down counting is detected by AND circuit 183 receiving the count=0 signal received over line 187 from counter 170. The inhibit down latch 188 enables AND circuit 183 during an error recovery procedure. The timing pulse T3 received over line 189 rapidly counts jam counter 170 down to zero for indicating the correct number of copies lost. Inhibit down latch 188 is set via AND circuit 192 by a 0A pulse received over line 190 and all of the stages in shift register 124 being equal to zero as indicated by the signals received over cable 191 from register 124. Latch 188 is reset by the next-received 0B pulse (see FIG. 8).

Additionally, misfeed detector 21 has AND circuit 195 for setting excess latch 92 via A0 106 by supplying a signal over line 196. AND 195 is activated whenever a previous misfeed has not been memorizied, as indicated by the signal on line 198 from FIG. 6; as will be later described, the line 91 collate mode and CR5 are set.

Figure 7:
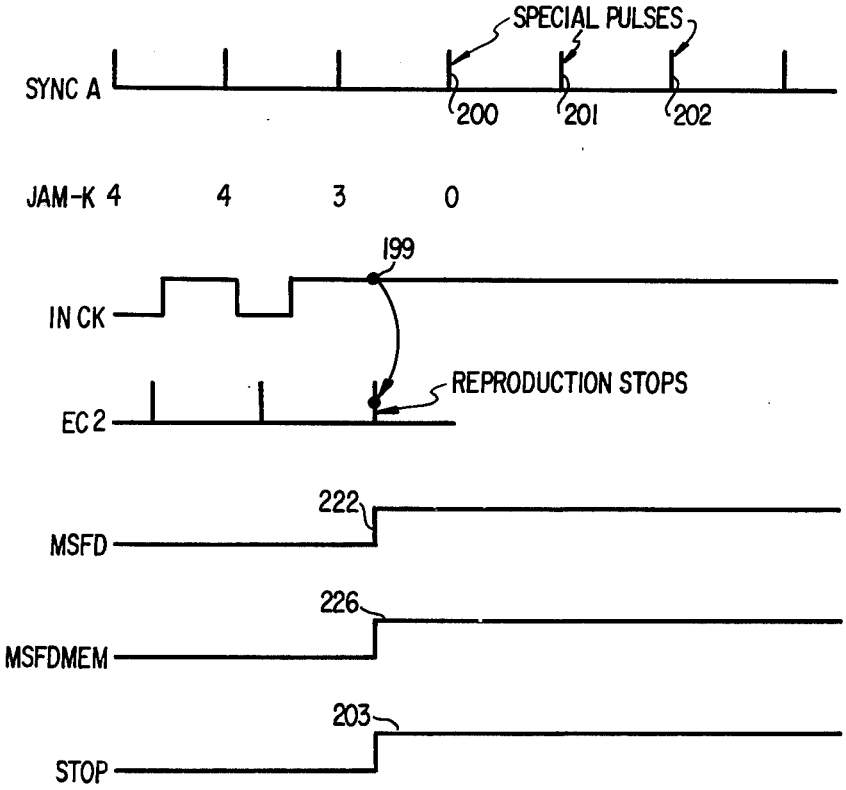
FIG. 7 is a timing diagram showing some error recovery timing.

Referring to FIG. 7, timing for the recovery just described is shown. SYNCA pulses indicate the beginning of reproduction cycles. Assuming a jam at transfer point 12, the jam counter is at count 3, i.e., one below the maximum of four copies in the transfer path. Input check latch 128 is activated as aforedescribed, being tested by EC2. At point 199, latch 128 was not reset and EC2 travels through AND circuit 132 stopping the machine. At this point, the emitter wheel 120 also stops. As will become apparent, several things occur. Special pulses replace SYNCA as at 200, 201, 202, et seq. Reproduction stops, and a plurality of latches including a stop latch 220 (FIG. 6) represented by signal 203 is set to the active condition. Special pulses are generated by an oscillator (not shown) as distributed in accordance with the miscellaneous control circuits described later with respect to FIG. 8. As aforementioned, the count down of jam counter 170 from 3 to 0 occurs rather rapidly. For each hard stop, emitter wheel 120 stops. Then, the special signals or pulses operate collators 14 and 15 in a near-normal manner for collating copies in the paper path at jam time. In this instance of jam recovery, jam counter 170 decrements in the normal manner via switches 33′ and 33A′ as the copies are collated.

After a jam recovery, check latches 128, 129, and 135–138 are reset by a JRST signal received over line 229 from a later-described circuit down in FIG. 8. Additionally, latches 128, 129, 135, and 137 can be reset by a reset signal on line 229A generated in a manner similar to JRST.

INTERLOCK CIRCUITS

Referring next to FIG. 6, circuits for interlocking the stopping and starting of the document reproduction machine with respect to the machine status of the transport apparatus from transfer point 12 to receiving tray 13 or collators 14 and 15 are described. In a document reproduction machine used with the preferred embodiment, the machine can be started either by a start button 210, which is suitably interlocked in document reproduction machine portion 10 by circuits (not shown), or by inserting an original into an automatic document feed apparatus (not shown). Accordingly, interlock circuits 42 include a start button interlock 211 and an original feed interlock circuit 212. Additionally, the misfeed control circits 213 are included as well as a start received synchronizing circuit 214.

In the misfeed portion 213 of interlock circuits 42, the stop-in signal on line 168 received from misfeed detector 21, sets stop latch 220 which stops document reproduction machine portion 10 and all other illustrated portions of the present application. The stop-in signal also travels through OR circuit 221 setting misfeed latch 222. Misfeed latch 222 then supplies an activating signal to set stop feed latch 225 of feed interlock circuits 212. This action also supplies the misfeed signal over line 24, as previously referred to. The misfeed signal on line 24 also sets misfeed memory latch 226 via OR circuit 227. The purpose of misfeed memory latch 226 is to maintain the misfeed indication within automatic control 16 until certain conditions have occurred in the misfeed recovery procedures, inter alia, to prevent inadvertent copy count errors. The soft stop signal "copy stop" received over line 173 also travels through OR circuit 221 setting misfeed latch 222. It, however, does not set the stop latch 220. Misfeed latch 222 is reset after manual intervention has been verified as indicated by the signal JRST received over line 229 from the FIG. 8 illustrated miscellaneous control circuit. In this regard, in FIG. 8, JRST signal is generated by AND circuit 230 which, in turn, responds to a plurality of manually actuated switches 231 corresponding to manual intervention points (not shown) in the document reproduction machine and in the illustrated apparatus. Upon manual intervention at each of the points, the switch closes for enabling AND 230. In a preferred form, the paper path switches 141A, 145A, 33′, and 33A′ are also used to generate JRST. Removal of a copy activates contacts 141B and 145B as described above. Further, a timing signal, such as 0A, as later described, times AND circuit 230 activation.

Misfeed memory latch 226 also can be set upon receiving an error indicating signal from document reproduction machine portion 10 over line 232. The signal on line 232 signifies that manual intervention has been required from some reason in document reproduction machine 10. Such signal may also result from a stop signal being supplied by stop latch 220 over line 233.

Start interlock circuit 211 has three control latches for interlocking the operation of automatic control means 16 and document reproduction machine portion 10. A start new run enable signal on line 237 is supplied by AND circuit 238 in response to a plurality of conditions. The last copy signal on line 98 must coincide with latch 239 being reset and latch 250 is set, as hereinafter detailed. End-of-run latch 239 has been reset from the active condition via OR circuit 240 as by last-copy signal on line 98 or by AND circuit 241. See the FIG. 5 timing diagram. AND circuit 241 resets end-of-run latch 239 only when a stop button 242 (panel 18) in control 20 was actuated, CR1 stage of shift register 124 is set (line 294), and misfeed memory latch 226 is reset. Additionally, single copy control signal on line 244 is received from miscellaneous control circuits of FIG. 8 to complete actuation of AND 241.

Latches 250 and 252 provide a delay start time whenever the start button 210 is actuated during start interlock time. Latch 252 is a resynchronizing latch used to synchronize setting disable start latch 250. AND circuit 251 responds to latch 252 being set and the other indicated conditions to set latch 250. One condition is the plural copy run signal on line 244 received from the FIG. 8 illustrated circuits. Hold start latch 252 is the resynchronizing latch set by AND circuit 260 which responds to the 0B pulse, not start signal on line 257, not misfeed signal from latch 226, single copy signal on line 244, the not last copy signal on line 255, the end-of-run signal from latch 239. Portion 10 starts a new run after the line 237 signal is active.

Hold start latch 252 is reset by the last-copy signal on line 98 via OR circuit 261 or the reset signal from AND circuit 241, which also resets end-of-run latch 239. Disable start latch 250 being set memorizes that start button 210 was actuated. AND 238 combines this memory with the last-copy signal on line 98 and end-of-run latch 239 signal to supply the start new run signal. The end-of-run latch 239 is set to the initial condition by AND circuit 262 in feed interlock circuits 212. AND 262 receives the not CR1 signal (CR1 is reset) on line 243, as well as the CR3 signals respectively on lines 263 and 264. Additionally, the not misfeed latch signal from latch 222 received over line 265 completes the enablement of AND 262 for setting end-of-run latch 239. AND 262 signifies that, CR1 being reset, the transfer point 12 is not receiving additional copies beyond what is already signified by CR2, CR3, and CR4. Accordingly, the end of the run is imminent. In this manner, AND circuit 262 also detects the occurrence of a last copy.

Feed interlock circuit 212 operates similarly to that described for starting interlock circuit 211. Stop feed signal is generated by OR circuit 268 from latch 225. The stop feed signal on line 269 disables the original document feeding mechanism (not shown) of document reproduction machine 10. A bin-full signal from line 270 signifies that collators 14 and 15 are full and no more copies can be received. Also, stop feed latch 225 supplies the stop feed signal whenever set via OR circuit 271. Inputs through OR circuit 271 include the output of AND 262 (previously described), misfeed latch 222 signal received over line 272, or the manual intervention signal received from document reproduction machine 10 over line 232. Stop feed latch 225 inhibits original document feeding until A0 275 resets the latch. The A1 input portion of A0 275 responds to the last-copy signal on line 98 and the not misfeed latch signal from line 265 to reset the stop feed latch 225. Also, the A2 input portion of A0 275 responds to the not misfeed memory latch 226 signal received over line 198 and to the start signal received over line 277 from the start synchronizing circuits 214 which receive a start indicating signal over line 278 from document reproduction machine portion 10. Circuit 214 includes a pair of interconnected latches 279 and 280 which generate a single pulse via AND circuit 281 for resetting stop feed latch 225 via A2 input portion of A0 275. Circuit 214 receives an actuating signal from portion 10 only after portion 10 has received the line 237 signal.

Misfeed memory latch 226 is not reset until documents have been successfully started to be reproduced in document reproduction machine 10 has indicated by the CR2 stage of shift register 124 being set as indicated by the signal on line 263. In this regard, OR circuit 285 passes the CR2 signal from line 263 resetting misfeed memory latch 226. In the alternative, AND circuit 286 responds to misfeed latch 222 being reset as indicated by the signal on line 265. The collator 14 motor being turned off is indicated by the signal on line 287 received from the collator 14 motor (details not shown), and a reset signal on line 288 is received from a manual switch as indicated by numeral 231 of FIG. 8.

Figure 8:
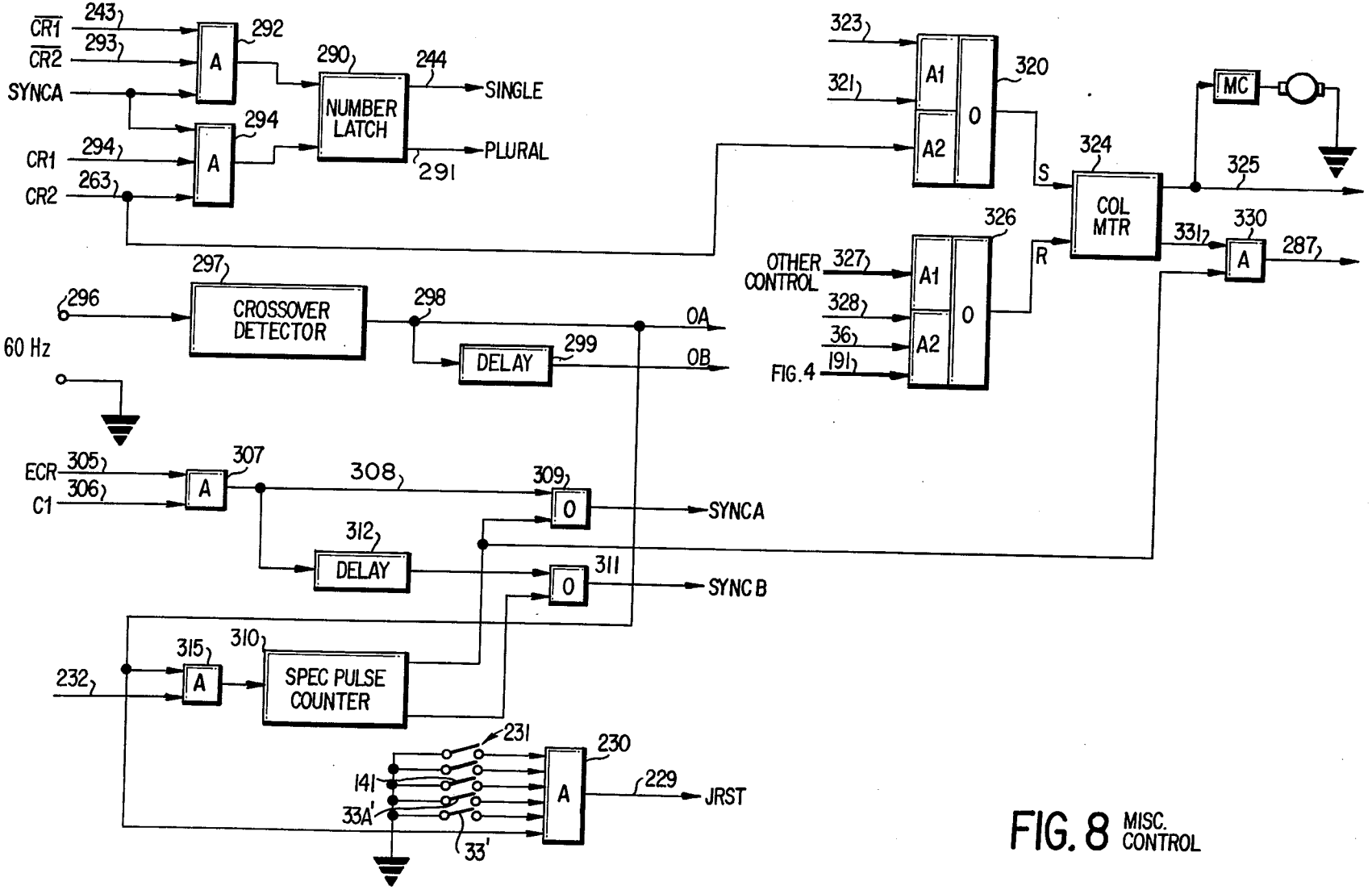
FIG. 8 is a collage of miscellaneous control circuits of automatic control means shown in FIG. 1.

The miscellaneous control circuits of FIG. 8 include the number latch 290 signifying whether a single copy is to be made as indicated by the signal on line 244A or if plural copies are to be made as indicated by the signal on line 291. A single copy run is detected by AND circuit 292 responding to a SYNCA pulse and the fact that CR1 and CR2 are simultaneously reset as indicated by the signals on lines 243 and 293. Similarly, AND circuit 294 detects plural copy mode by passing the SYNCA pulse whenever CR1 and CR2 are simultaneously active as indicated by the signals on lines 294 and 263, respectively.

The FIG. 8 control circuits further include generation of the 0A, 0B, SYNCA, and SYNCB pulses. A 60 Hz signal is received at terminal 296 from a usual power line. A zero-crossover detector 297 supplies a pulse for each detected zero crossover over line 298 as a 0A pulse. A 0B pulse is generated from the 0A pulse via delay circuit 299.

SYNCA and SYNCB pulses are generated by a timing reference pulse received over line 305 labeled "ECR" from an emitter wheel 120. Similarly, a timing pulse on line 306 labeled "C1" received from the document reproduction machine and signifying start of a cycle, enables AND circuit 307 to supply a pulse for each document reproduction cycle over line 308. OR circuit 309 combines the line 308 signal with a signal received from the special pulse counter 310 as a SYNCA pulse. It may be remembered that special pulses from counter 310 are used during error recovery procedures as described earlier. Similarly, OR circuit 311 combines the delayed SYNCA pulse from delay circuit 312 with pulses from special pulse counter 310 as SYNCB pulses, both SYNCA and SYNCB pulses being shown in FIG. 3. Special pulse counter 310 is actuated by AND circuit 315 whenever line 232 manual intervention is activated by document reproduction machine 10. The 0A pulses on line 298 pass through AND circuit 315 to generate the SYNCA and SYNCB pulses.

The FIG. 8 circuits also include a collator motor control for actuating the collator 14 motor. A0 circuit 320 has an A1 input portion which receives the not stop signal over line 321 from the FIG. 6 converter 322 and a start collator signal received over line 323 from document reproduction machine control 20 to set collator motor latch 324 to the active condition for supplying a collator motor start signal over line 325. Latch 324 is reset by A0 326 via its A1 input portion by other controls received over cable 327 which is beyond the scope of the present description. The A2 input portion also causes collator motor latch 324 to be reset. Whenever switch 48 supplies its signal over line 36, a timing signal from an oscillator (not shown) received over line 328 and all of the shift register 124 stages are reset, as indicated by the signals received over cable 191; i.e., all of the copies have been collated. Collator motor latch 324 being reset disables the collator motor by removing the activating signal from line 325. Additionally, AND circuit 330 responds to the not collator motor signal on line 331 and the special pulse from counter 310 to supply the line 287 not collator motor signal used in the FIG. 6 illustrated circuits.

While the invention has been particularly shown and described with reference to a preferred embodiment thereof, it will be understood by those skilled in the art that various changes in form and detail may be made therein without departing from the spirit and scope of the invention.

What is claimed is:

1. A document handling apparatus having an input transfer point, paper path means for carrying documents from said transfer point to a deflection gate for directing documents to one of two output portions, plural sensing means distributed along said paper path and said output portions to indicate document presence or absence, operator control means indicating mode of operation of said apparatus;

the improvement including in combination:

means indicating that a document is to enter said paper path from said transfer point;

a shift register receiving said indication and shifting same to indicate possible locations of documents irrespective of ultimate document destination;

first checking means responsive to a first portion of said shift register and to first ones of said sensing means to indicate a misfeed;

second checking means responsive to said first portion of said shift register, to second ones of said sensing means, to a first one of said output means receiving said documents, and to said operator control means indicating a first mode of operation to indicate a misfeed; and third checking means responsive to said first portion of said shift register, to third ones of said sensing means, and to said operator control means indicating a second mode of operation to indicate a misfeed.

2. Apparatus as set forth in claim 1 further including in combination:

said second checking means includes a latch having an input setting means responsive to first and second modes respectively and to operational states of said machine at different predetermined times, respectively, to set said checking latch and further including first and second AND circuit means responsive to said latch being set at respective first and second times to indicate a misfeed.

3. The subject matter of claim 1 further including misfeed indicating means and misfeed indicating memory means;

said misfeeding indicating means being responsive to said first and second checking means to memorize a misfeed;

means in said misfeed indicating means setting said misfeed indicating memory means;

reset means responsive to manual intervention of said machine for resetting said misfeed indicating means;

said misfeed indicating memory means including means responsive to said document indicating means to reset; and interlocking means responsive to said misfeed indicating memory means for enabling article transfer into said paper path means.

4. The apparatus set forth in claim 1 wherein said first portion has first and second bistable stages, said first bistable stage first receiving an indicating signal and then shifting it to said second stage which, in turn, supplies same to another portion of said shift register;

said first checking means including an input check latch and an output check latch respectively receiving signals from said first and second stages; and said second cheking means including third and fourth latches, said third latch receiving signals from both said first and second stages and said fourth latch receiving signals only from said second stage whereby each first and second stage enables checking at various points of the travel path.

5. The apparatus set forth in claim 4 wherein said apparatus further includes:

mode control means such that documents traveling along said paper path have alternative routes in accordance with the mode selected; and said checking means having plural AND input means to said third input latch, one of said AND input means being responsive to said modes, respectively, and to one of said stages, respectively.

6. The apparatus set forth in claim 5 further including reset means for resetting said third checking latch, said resetting means including a single switch responsive to documents in said travel path at a given point of travel irrespective of mode of operation.

7. The apparatus set forth in claim 1 wherein said shift register has a copy-coming portion supplying said entering indication to said first portion, and a second portion receiving said entering indication of said first portion;

a document reproduction machine having an emitter wheel emitting machine state timing signals and supplying at least one of said machine state timing signals to said copy-coming portion for shifting said pulse through said copy-coming portion, said first portion, and then said second portion for indicating desired copy transport status in said apparatus along said paper path means, said first portion having first and second serially connected stages;

said second portion having first and second serially connected stages;

output means including portions for receiving documents at times respectively having machine states indicatable by said first and second stages of said second portion;

said first checking means including first and second latches each having set input means responsive to said stages of said first portion, respectively, and including means receiving some of said machine state pulses from said emitter wheel for setting said latches;

said second checking means including third and fourth checking latches, said third checking latch including dual AND circuit type input means respectively connected to said first and second stages of said first portion and said fourth latch including AND input means connected to said second stage of said first portion;

mode indicating means indicating first and second modes and respectively connected to said first and second AND input means of said third latch for gating the signals from said first and second stages of said first portion to said third latch;

third checking means including first and second latches, said first latch of said third checking means having dual AND input means, both of which are connected to said second stage of said first portion and responsive to said mode indicating means for setting said first latch of said third checking means at different times in accordance with said pulses from said emitter wheel;

said second latch of said third checking means including dual AND input means connected to said second portion and to said load selection means for respectively setting said second latch of said third checking means at differing times; and independent resetting means connected to each of said latches for resetting same in accordance with document transport state of said paper path means.

8. The apparatus set forth in claim 7 wherein each of said checking means includes AND means jointly responsive to said latches, respectively, and to predetermined ones of said timing signals;

said third latch and said first latch of said third checking means including dual AND circuit means responsive to said mode selection means and to differing ones of said timing signals for indicating fault conditions; and OR circuit means receiving signals from all of said output AND checking circuits for indicating a misfeed in said paper path means.

9. The apparatus set forth in claim 8 further including a misfeed latch and a stop latch, said OR circuit means supplying a signal for setting both stop and misfeed latch;

further fault detection means responsive to predetermined conditions of said paper path for setting said misfeed latch and not said stop latch; and error recovery means for moving documents in said travel path to destinations whenever said misfeed latch is set and said stop latch is not set.

10. Apparatus set forth in claim 9 further including misfeed memory means responsive to said misfeed latch being set to maintain an indication of said misfeed;

manual intervention means generating a JRST signal resetting said misfeed latch; and said copy-coming portion having a plurality of shift stages and a stage other than the first stage of said copy-coming portion operative to reset said misfeed memory means by misfeed indications removed for enabling misfeed recoveries while misfeed memory is maintained until a subsequent copy run is initiated for facilitating intermediate control between error recovery and indicating restart.

11. The apparatus set forth in claim 9 further including a first up/down counter responsive to documents entering said travel path means and for counting up and responsive to documents leaving said travel path means for counting down; and said error recovery means for down counting said first up/down counter for resetting count conditions indicative of copies lost in a misfeed.

12. The apparatus set forth in claim 11 further including:

a second up/down counter responsive to documents entering said paper path means for up counting for counting the number of documents to a given one of said output portions and responsive to down counting said first up/down counter to down count in a like manner;

decode means on said second up/down counter and supplying a plurality of control signals indicative of the number of copies to said one output portion; and excess latch means responsive to one of said decoded counts for assuming an active condition and supplying control signals for switching said deflection gate to direct documents to a second one of said output portions.

13. A control for article conveying along a controlled article transfer path;

input means supplying articles to be conveyed and associated timing signals;

a shift register having a plurality of shift stages receiving and storing first ones of said timing signals, one stage per check point area of said article transfer path;

plural means sensing article transport along said article transfer path;

a check latch connected to predetermined stages of said shift register;

gate means responsive to second ones of said timing signals to set said check latches to a checking signal state only when corresponding ones of said shift stages contain a signal representative of one of said first timing signals;

third ones of said timing signals sensing the signal state of said check latches; and fault detection means responsive to any one of said check latches being set to said active signal state and to third given ones of said timing signals to indicate a jam, and having means for disabling said input means whereby no more articles nor timing signals are supplied such that a pattern of signals in said shift register and said check latches constitutes an indication of an article transport state existing at a jam detection time.

14. The control set forth in claim 13 wherein a plurality of check latches are connected to one of said predetermined stages;

a machine operable with said article transfer path having a plurality of modes of operation;

means indicating modes of operation for gating signals from said one of said predetermined stages to predetermined ones of said plurality of check latches in accordance with said mode indication; and timing means supplying a plurality of timing pulses such that said signal from said one of said predetermined stages is gated to said check latches at differing times.

15. The control of claim 13 further including a machine associatable with said article transfer path and including a machine article transfer path supplying articles to said controlled article transfer path, said shift register having a plurality of shift stages associatable with said machine article transfer path and a plurality of shift stages receiving signals from said first-mentioned shift stages indicating desired article transport status in said controlled article transfer path;

means in said machine supplying pulses indicative of article transfer cycles for shifting indicia through said shift register in accordance with a desired machine repetition rate;

a first portion of said shift register indicating operation of said machine prior to articles reaching said controlled article path;

error recovery means responsive to said fault detection means for indicating article transfer malfunction including malfunction memory means; and one of said shift stages in said shift register associatable with said machine operation resetting said memory means.

16. The control set forth in claim 13 further including means indicating the number of articles in said controlled article transport path at a given time; and means responsive to said fault detection means for down counting said number of article indicating means including coincidence means responsive to said shift register stages indicating clear paper path for inhibiting down counting.

17. The control set forth in claim 13 wherein a plurality of output means receive articles from said controlled article path, said shift register indicating machine state of said controlled article transfer path irrespective of output means destination; and predetermined latches associatable with a one of said shift stages in said shift register representing checking with respect to differing ones of said output means.

18. The control set forth in claim 13 wherein a machine supplying articles to said controlled article transfer path has a synchronizable relationship with operation of said article transfer path;

interlock means inhibiting starting an operation of said machine in a first mode and not inhibiting starting an operation of said machine in a second mode; and misfeed means in said fault detection means inhibiting operation of said machine in any mode whereby error recovery of said controlled article transfer path is enhanced.

19. The control set forth in claim 13 further including a first up/down counter indicating the number of articles in said controlled article transfer path;

a plurality of output means operatively associated with said article transfer path including article deflection means for transferring articles to one of said output means;

second up/down counter means counting articles transferred to said one output means; and error recovery means down counting said first up/down counter means and simultaneously down counting said up/down counter and supplying signals indicative of the down count for use outside of said control.

20. Document reproduction apparatus for selectively making one or more individual duplicate documents from an original document, or for making a number of collated document sets of a multipage original document, including in combination:

means indicating receipt of a document;

a copy tray adapted to receive said individual duplicate documents;

a first sensor cooperating with said tray and operable to detect the presence of a first given number of duplicate documents therein;

a second given number of collator bins, each said collator bin adapted to receive a third given number of duplicate documents;

first up/down counter means responsive to said indicating means for indicating the number of duplicate documents transferred to each said collator bin, decode means responsive to said first up/down counter means to indicate a third given number of duplicate documents;

document deflector/conveyor means operable to selectively convey duplicate documents from a copier to said tray and to said bins, such that duplicate documents are sequentially deposited in the first to an Nth bin, N being an integer;

operator control means enabling selection of a copy or collate mode of operation;

automatic control means actuatable by said operator control means and constructed to facilitate a copy request for a number of noncollated copies greater than said first given number, or a collate request for a number of collated sets greater than said second given number;

said automatic control means including gate bistable means indicating deflection of documents to said tray when in an inactive condition and to said collator in an active condition;

first AND input means to set said gate bistable means to the active condition in response to said first sensor indicating said first given number and to said indication of a received document;

second means for resetting said gate bistable means to said inactive condition;

a collator including said collator fins for receiving documents to be collated, including indexing means;

second decode means indicating a number of received documents greater than said second given number;

excess bistable means responsive to said second decode means and said collator to indicate an excess number of documents;

third AND means responsive to said excess bistable means and to said received documents indication to reset said gate latch to said inactive condition;

fourth AND means responsive to said collator and to said excess latch being reset to reset said gate bistable means to the inactive condition; and fifth means to reset said first up/down counter and said excess latch whenever a new run of documents is to proceed.

21. Apparatus set forth in claim 20 further including:

means in said operator control means indicating collate mode and noncollate mode;

collator indicator means indicating said collator is ready to receive documents in a predetermined manner;

said first AND means further being only responsive to said noncollate mode indication and to said collator indication means to set said gate bistable means; and sixth AND means responsive to said collate indication and to said excess latch being reset to set said gate bistable means to the active condition.

22. The apparatus set forth in claim 20 wherein said fifth means includes first separate means to reset said first up/down counter in response to said collator indexing means and to said noncollate indication and having second separate means to reset said first up/down counter in response to said gate bistable means being reset and to said collator indexing means indicating a collator completed operation;

misfeed detection means;

a document in transit indicator; and down count means responsive to said misfeed detection means and to said document in transit indicator to down count said first up/down counter irrespective of said mode indications.

23. The apparatus set forth in claim 22 further including interlock circuits logically interposed between said operator control means and said automatic control means;

first hold means in said automatic control means indicating a plural copy run;

second hold means in said automatic control means indicating last copy; and means responsive to both said hold means to inhibit initiation of a copy run by said operator control means.

24. A control for an article transfer apparatus having a plurality of article sensing means for supplying error indicia and being disposed along a path of article travel, said path of travel having a plurality of branches to a like plurality of destinations, the improved control including in combination;

a first up/down counter for indicating a number of articles currently being transferred through said apparatus;

a second up/down counter for counting articles traveling to a given one of said branches;

error recovery means responsive to an error indicia from one of said article sensing means to alter the count of said second up/down counter in accordance with the content of said first up/down counter; and means to erase the content of said first up/down counter as said second up/down counter content is altered.

25. The control set forth in claim 24 further including in combination:

mode control means for operating said second up/down counter;

means responsive to said mode control means and a count in said second up/down counter to reset said second up/down counter to a predetermined count state; and means operative substantially simultaneously with resetting said second up/down counter to alter direction of document travel from one of said branches to another of said branches.

26. The subject matter set forth in claim 25 further including misfeed detection means;

misfeed latch means responsive to said misfeed detection means to indicate a misfeed condition;

said error recovery means responsive to said misfeed indication as said error indicia; and misfeed memory means for maintaining said misfeed indication after said misfeed is cleared for inhibiting predetermined functions in said control.

27. The control set forth in claim 24 wherein said error recovery means further includes a misfeed latch means and a misfeed memory latch means, both latch means responsive to said error indicia to supply misfeed signals for actuating said error recovery means to alter the count of said second up/down counter in accordance with the content of the first up/down counter;

reset means responsive to manual intervention for resetting one of said latch means;

operation indicating means responsive to a successful restart of said apparatus to reset a second of said latch means; and means in said control for operating said machine responsive to said one latch means to inhibit certain operations until reset.

28. The control set forth in claim 24 further including an article tracking register supplying signals indicative that an article is in said path of article travel;

inhibit altering means in said error recovery means responsive to said error tracking register indicating no articles for inhibiting further alteration of said second up/down counter; and said inhibiting means being further responsive to said first up/down counter being erased to inhibit further alteration of said second up/down counter.

29. The control set forth in claim 28 further including interlocking circuit control means for inhibiting restarting operation of the article transfer apparatus;

single copy indicating means inhibiting operation of said interlock circuits; and means in said interlock circuit responsive to said article tracking means to enable restarting said article transfer apparatus.

30. A control for a document transport apparatus;

means for receiving documents and associated timing signals, a plurality of output means; the improvement including in combination;

sensing means responsive to document transport to indicate transport status in said apparatus;

intermediate counting means counting documents transported;

first means responsive to a predetermined transport status to automatically reset said intermediate counting means; and second means responsive to a given transport status to decrement said intermediate counting means by a predetermined number.

31. The control set forth in claim 30 further including in combination:

transient counting means indicating number of documents in the document transport apparatus at a given time; and down count control means in said second means responsive to said given transport status and to said transport counting means indication to decrement said intermediate counting means in accordance with said transient counting means indication.

32. The control set forth in claim 30 further including in combination:

document count decode means responsive to said intermediate counting means for indicating said predetermined transport status; and multi-output selecting means responsive to said first means when resetting said intermediate counting means for selecting an output means to receive documents other than an output means receiving documents being counted by said intermediate counting means whereby said intermediate counting means can count documents up to said predetermined transport status.

33. The control set forth in claim 30 further including misfeed detection means comprising:

a copy tracking register having a plurality of status indicating states responsive to said associated timing signals to indicate a supposed document transport status in said document transport apparatus;

a plurality of check latch means for detecting misfeed conditions at predetermined points in said document transport apparatus and having a misfeed testing state and a nonmisfeed indicating state;

sensing means at each said predetermined point to reset corresponding ones of said check latch means to a nonmisfeed indicating state;

mode means indicating one of a plurality of modes of document transport;

first gating means in first ones of said check latch means responsive to first predetermined ones of said timing signals and to first predetermined ones of said status indicating states to set said first ones of said check latch means to a misfeed testing state;

second gating means in second ones of said check latch means responsive to said mode means, said first ones of said check latch means and respectively to second ones of said timing signals to set said second ones of said check latch means to a misfeed testing state;

one of said second timing signals being the same as one of said first timing signals; and misfeed detection means responsive to said check latch means being in said testing state, respectively, and to predetermined ones of said associated timing signals to indicate a document misfeed.

34. The control set forth in claim 30 further including in combination:

a misfeed indicating element in said second means to indicate said given transport status;

misfeed detecting means for setting said misfeed indicating element to indicate said given transport state;

means for resetting said misfeed indicating element to indicate other than said given transport state;

a misfeed memory element settable to indicate said given transport state whenever said misfeed indicating element indicates said given transport state; and means responsive to said associated timing signals and said misfeed indicating element being reset to reset said misfeed memory element to indicate other than said given transport state.

35. The control set forth in claim 34 further including in combination:

means indicating receipt of no documents by said apparatus; and interlock means responsive to said misfeed memory means and to said indication of receipt of no documents to supply a control signal enabling document transport.

36. A document transfer control;

an intermediate up/down counter;

means supplying a plurality of machine state indications;

first means responsive to a received document to up count said up/down counter;

reset means responsive to a given one of said machine state indications and a predetermined count in said up/down counter to reset said up/down counter;

misfeed detection means including means indicating document transport condition at misfeed time; and means responsive to said document transport condition indication to down count said up/down counter in accordance with said indicated document transport condition.

37. The document transfer control set forth in claim 36:

control means for actuating document deflection means to direct documents to one of a plurality of destinations;

means in said first means detecting receipt of a document to be transferred;

said reset means further including means responsive to said detecting means and to said predetermined count to reset said up/down counter; and means in said reset means to actuate said control means.

38. The document transfer control set forth in claim 37 further including in combination:

collate and noncollate indicating means;

collator index means in said control means to supply collator indexing signals for indexing a collator; and said reset means being further responsive to said noncollate indicating means to actuate said control means including actuating said collator index means.

39. The document transfer control set forth in claim 36 wherein said reset means is further responsive to said first means to reset said up/down counter; and inhibit means preventing simultaneous up counting and resetting said up/down counter by said first means and said reset means.

40. A paper path clearing control for a document reproduction machine, in combination:

means supplying timing signals indicating desired paper transport;

a paper path control operated by said timing signals associated with paper transport;

means detecting a paper path jam;

storage means indicating state of the paper path when a jam is detected;

recovery control means automatically supplying special timing signals independent of paper transport to the storage means for operating same as if no jam had occurred; and paper path operating means in said paper path control responsive to said recovery control means timing pulses for operating said storage means to operate an unjammed portion of said paper path in accordance with said paper path state indication.

41. The path clearing control set forth in claim 40 further including in combination:

timing means in said paper path control for receiving document indicating timing signals from said supplying means;

means inhibiting said supplying means;

means responsive to said inhibiting means to actuate said recovery control means; and substitute means in said recovery control means supplying said special timing signals in place of said document indicating timing signals.

42. The path clearing control set forth in claim 41 further including misfeed detection means comprising:

a document reproduction portion having an emitter wheel means constituting said supplying means supplying said document indicating timing means; and means stopping said document reproduction portion including said emitter wheel.

43. The path clearing control set forth in claim 42 further including means receiving alternating current power electrical energy used to power the document reproduction machine;

a detector detecting a predetermined phase of said power and supplying a control signal indication thereof; and said substitute means including means for receiving said control signal indications to supply said special timing signals.

44. An error recovery circuit for an electronically controlled document reproduction machine having a document reproduction portion, a document collection portion, and a document transfer means moving duplicate documents through said portions including from said document reproduction portion to said document collection portion, means in said document reproduction portion supplying timing signals indicative of a desired document transport and indicating a synchronism of document reproduction and handling, the improvement including in combination:

document handling error detection means capable of indicating a plurality of types of document handling errors;

stop means responsive to a first type error to stop the machine;

interlock means responsive to a second type error to stop said document reproduction portion; and special means responsive to said interlock means to supply special timing signals to operate said document collection portion independent of said document reproduction portion being stopped.

45. The error recovery circuit set forth in claim 44 including electronic means to generate first timing signals; and means in said special means for converting said first timing signals to special timing signals indicative of a desired document transport timing in said document collection portion.

46. A document reproduction machine having a reproduction portion with means to supply document cycle indicating signals, other portions in said machine responsive to said document cycle indicating signals to operate in a predetermined synchronism with said document reproduction portion;

means for stopping said document reproduction portion such that said document cycle indicating signals are no longer supplied even though said other portions may still be operating on documents received from said document reproduction portion; and electronic means supplying special cycle indicating signals to said other portions for operating same in a self-synchronous manner approximating said predetermined synchronism.

47. Collator-reproduction machine interlocking circuits, said collator and reproduction machine each having control circuits, copy transport means for transporting copies from said machine to said collator, the improvement to said collator control circuits including in combination:

means indicating a multiple-copy reproduction run including means indicating a single-copy run;

copy tracking means indicating number of copies in said copy transport means;

a start interlock circuit connected to said reproduction machine to enable starting a copy reproduction run;

disable means in said start interlock circuit responsive to said multiple-copy indication and not to said single copy indication to disable starting a copy reproduction run; and last-copy means responsive to said copy tracking means to reset said disable means to enable starting a copy reproduction run and supplying a last copy signal and a not last copy signal.

48. The interlocking circuits set forth in claim 47 further including in combination:

a first latch indicating that copies are in said transport path for actuating said disable means to prevent starting a copy reproduction run;

said first latch being responsive to said last-copy signal to enable said disable means to start a copy reproduction run;

means responsive to said copy tracking means in said copy transport means indicating copies in said transport means to set said first latch for actuating said disable means to disable a copy reproduction run start;

a second latch responsive to said first latch and to said multiple copy indication to disable said starting a copy reproduction run; and said disable means comprising AND circuit means responsive to said copy tracking means indicating no copy being received to actuate said disable means to enable a copy reproduction run start.

49. The interlock circuit set forth in claim 48 further including a hold start latch responsive to said first latch, not last copy signal, to said multiple copy indication, and a not misfeed condition to set to an active condition and supplying an enabling signal for setting said second latch and means responsive to said last-copy signal and to said AND circuit means to reset said hold start latch for enabling resetting said second latch.

50. The interlock circuit set forth in claim 47 further including:

a first misfeed latch and a second misfeed latch;

jam sensing means operative to set both said misfeed latches;

jam reset means operative to reset said first misfeed latch;

means in said article tracking means indicating a successfull start for resetting said second misfeed latch;

said second misfeed latch actuating said start interlocking circuit for enabling a copy reproduction run; and means for initiating a stop feed signal and being jointly responsive to said misfeed latches and to said copy tracking means to eliminate said stop feed signal for enabling feeding original documents to said reproduction machine.

51. The circuit set forth in claim 50 further including a stop latch supplying a stop signal to said document reproduction machine for turning off all operations;

manual means for resetting said stop latch;

fault detecting means of a first type operative to simultaneously set said stop latch and said misfeed latches; and additional fault detection means for setting said misfeed latches but not said stop latch.

52. A document reproduction machine having a document reproduction portion for supplying duplicate copies via a transfer point to a document transfer path means, a plurality of output portions for receiving documents from said document transfer path means, document guiding means in operative relationship to said document transfer path means for directing documents to one of said output portions, the improvement including in combination:

copy tracking means including a copy-coming tracking portion indicating desired copy transport in said document reproduction portion, a first tracking portion indicating desired copy transport in said article transfer path and a second tracking portion, each tracking portion having a plurality of signal states;

fault detecting means responsive to said first and second tracking portions to indicate a misfeed;

first interlocking circuits responsive to said copy-coming tracking portion and to said fault detecting means to inhibit said document reproduction portion from starting a copy run; and second interlocking circuits responsive to said fault determining means to indicate to said document reporduction portion to stop feeding copies and having means responsive to said copy-coming tracking portion to remove said misfeed indication.

53. The document reproduction machine set forth in claim 52 wherein:

said fault detecting means has a plurality of checking means operatively connected to said first tracking portion, each checking means having a reset state indicating a no-fault detected condition;

mode means indicating one of a plurality of document transport modes in said other portions;

means electrically interposed between said first tracking portion and said checking means and responsive to said mode means to alter operation of said checking means response to said first tracking portion in accordance with said one transport mode.

54. The document reproduction machine set forth in claim 53 wherein one of said checking means exhibits a plurality of responses to one of said first tracking portion signal states in accordance with said mode means.

55. The document reproduction machine set forth in claim 54 further including one and only one document sensing means operatively associated with each said checking means; and each said checking means responsive to said operatively associated one and only one sensing means to assume said reset state irrespective of said mode means imposing differing responses thereof to said first tracking portion.

56. The document reproduction machine set forth in claim 52 further including in combination:

emitter means in said document reproduction portion supplying document transport indicating timing signals;

timing means in said other portions responsive to said document transport indicating timing signals to time operations of said other portions in a predetermined synchronism with said document reproduction portion;

means stopping said document reproduction portion and means supplying a control signal indicating said stoppage; and recovery means in said other portions responsive to said control signal and said copy tracking means to supply special timing pulses for timing operations of said other portions in a self-synchronism approximating said predetermined synchronism.

57. The document reproduction machine set forth in claim 56 wherein said document reproduction portion has a copy tracking unit substantially similar to said copy-coming tracking portion;

said emitter means identically actuating said copy tracking means and said copy tracking unit; and said recovery means actuating only said copy tracking means.

58. A document reproduction machine having a document reproduction portion and other portions, means synchronizing operations of said portions, the improvement including in combination:

status indicating means in said other portions;

a first document tracking means in said document reproduction portion having a predetermined number of stable signal states for indicating a document transport status of said document reproduction portion;

a second document tracking means in said other portions having a first portion having said predetermined number of signal states and having other portion tracking means receiving signals in accordance with said predetermined number of signal states in said first portion of said second document tracking means with a second predetermined number of signal states;

means in said document reproduction portion simultaneously and identically actuating said first document tracking portion and said first portion of said second document tracking portion; and interlock circuit means in said other portions responsive to said first portion of said second document tracking portion and to said status means to supply predetermined control signals to said document reproduction portion.

59. The method of operating a document reproduction machine capable of single or plural copy run reproduction modes, the steps of:

supplying copies of plural separate single copy runs in a single transport path at a given time during the single copy reproduction mode; and limiting copies in said single transport path to a given copy run in a plural copy reproduction mode.

60. The method set forth in claim 59 wherein each copy can go to one of a plurality of destinations;

sensing a last copy of a copy run in said plural copy mode at all said plurality of destinations and supplying a signal indicating document sensed; and combining all said plurality of sensing signals to supply a start enable signal to permit a new copy run in said plural copy reproduction mode.

61. The method of operating a copy transport and collection apparatus for being attached to a document reproduction apparatus which supplies copies via a transfer point to said copy transport and collection apparatus with associated copy indicating signals and plural mode indicating signals, means in said document reproduction apparatus for receiving start interlock signals, the improved method including the steps of:

storing said copy indicating signals;

combining said mode signals and one of said copy indicating signals to indicate one of a plurality of predetermined desired copy transport state in accordance with said mode signals;

sensing for said desired copy transport status; and indicating a misfeed when said sensed status and said desired status are different at a predetermined time.

62. The method set forth in claim 61 further including the steps of combining a first one of said mode signals with said one of said copy indicating signals at a first time and combining a second one of said mode signals with said one of said copy indicating signals for indicating two of said desired copy transport states.

63. The method set forth in claim 62 sensing for both of said two desired copy transport states at one point in said copy transport apparatus; and testing for concurrence of said two desired transport states and said sensed state at said one point at first and second times, respectively, said second time being later than said first time.

64. The method set forth in claim 61 further including the steps of:

associating said copy indicating signals with predetermined points along a copy transport path;

combining said mode signals with said associated copy indicating signals for establishing a plurality of misfeed test times for a plurality of points along said transport path, respectively, such that one of said copy indicating signals being associated with one of said points at a time determined by said mode signals.

65. The method set forth in claim 64 further including the steps of:

indicating document reproduction cycles and a plurality of phase positions of said document reproduction portion, one of said cycle indications being a copy indicating signal for one document reproduction cycle; and timing said combining steps with predetermined ones of said cycle indications.

66. The method of detecting a misfeed in a document transport path, receiving documents from a cyclically operating document reproduction apparatus, the steps of:

supplying mode of operation signals indicating one of a plurality of operation modes resulting in different timing of operation of said document transport paths;

storing machine status signals indicating a desired transport position for a plurality of documents being successively and simultaneously transported along a document transport path;

combining one of said machine status signals with said mode of operation signals at differing times within a machine cycle in accordance with said mode of operation signals;

irrespective of said mode of operation signals, sensing for said transport position of a given document corresponding to said machine status signal; and verifying said indicated desired transport position at at a given time in a machine cycle in accordance with said mode of opertion.

67. The method of operating a document reproduction machine having a plurality of interacting operating portions, the steps of:

supplying document transport indicating timing signals from one of said operating portions;

operating other ones of said operating portions in a predetermined synchronism with said document transport indicating timing signals;

stopping said one portion and said document transport indicating timing signals; and supplying substituted timing signals to said other portions upon stopping said document transport indicating timing signals for operating said other portions after said one portion has stopped.

68. The method set forth in claim 67 wherein said one operating portion is a document reproduction portion operable in repetitive document reproduction cycles, said document transport indicating timing signals having fixed phase relationships to said repetitive document reproduction cycles;

generating special timing signals using a predetermined time base independent of said interacting operating portions; and frequency dividing said special timing signals to generate said substitute timing signals in one approximate cycle time related to said document reproduction cycles.

69. A control for a documentation reproduction machine having a reproduction portion and a transport and output portion, the improvement including in combination:

a first copy tracking circuit in said reproduction portion having a first predetermined number of signal states indicating transport status;

a second copy tracking circuit in said transport and output portion with a first portion having said first predetermined number of signal states indicating said transport status and a second portion having a second predetermined number of signal states indicating transport status of said transport and output portion;

first control circuits responsive to said second portion signal states for supplying first control signals for operating said transport and output portion; and second control circuits responsive to said first portion to supply control signals to said reproduction portion.

70. A misfeed sensing arrangement for detecting misfeeds along a document travel path, the improvement including in combination:

a sensing station in said path supplying document received and document left signals;

means indicating desired document transport positions;

timing means indicating a sequence of operations related to said desired document transport positions;

a first checking means responsive to said sensing station, a first one of said indicated positions and first ones of said indicated sequences to signal a paper jam; and a second checking means responsive to said sensing station, a second one of said indicated positions and predetermined ones of said indicated sequences to signal a paper jam.

* * * * *